US007779850B2

(12) United States Patent
Caldwell

(10) Patent No.: US 7,779,850 B2
(45) Date of Patent: Aug. 24, 2010

(54) ANTI-TIPPING DEVICE FOR WALKERS

(76) Inventor: Pamela Caldwell, 3375 Morning Dove Rd., Roanoke, VA (US) 24018

( * ) Notice: Subject to any disclaimer, the term of this patent is extended or adjusted under 35 U.S.C. 154(b) by 0 days.

(21) Appl. No.: 12/432,869

(22) Filed: Apr. 30, 2009

(65) Prior Publication Data

US 2009/0301533 A1 Dec. 10, 2009

Related U.S. Application Data

(60) Provisional application No. 61/059,019, filed on Jun. 5, 2008.

(51) Int. Cl.
*A61H 3/00* (2006.01)
*A45B 9/04* (2006.01)

(52) U.S. Cl. ..... 135/67; 135/66; 135/77

(58) Field of Classification Search ..... 135/65, 135/66, 75, 77; 297/5; 280/87.021, 87.041, 280/87.051; 482/66, 68, 69
See application file for complete search history.

(56) References Cited

U.S. PATENT DOCUMENTS

| | | | | |
|---|---|---|---|---|
| 2,745,465 | A | 5/1956 | Hogan | |
| RE24,817 | E | 4/1960 | Hogan | |
| 3,165,112 | A | 1/1965 | Ries | |
| 4,251,105 | A | 2/1981 | Barker | |
| 4,510,956 | A | 4/1985 | King | |
| 4,700,730 | A | 10/1987 | Samuelson et al. | |
| 4,805,925 | A | 2/1989 | Haury et al. | |
| 4,987,912 | A * | 1/1991 | Taylor | 135/67 |
| 5,347,666 | A | 9/1994 | Kippes | |
| 5,465,744 | A | 11/1995 | Browning | |
| 5,636,651 | A | 6/1997 | Einbinder | |
| 6,082,384 | A * | 7/2000 | Cheng | 135/66 |
| 6,530,598 | B1 | 3/2003 | Kirby | |
| 7,222,881 | B1 | 5/2007 | Zhou | |
| 2001/0048206 | A1 | 12/2001 | Niu et al. | |
| 2002/0175027 | A1 | 11/2002 | Usherovich | |
| 2003/0137119 | A1 | 7/2003 | Razon | |

* cited by examiner

*Primary Examiner*—David Dunn
*Assistant Examiner*—Danielle Jackson
(74) *Attorney, Agent, or Firm*—Michele L. Mayberry; New River Valley IP Law

(57) ABSTRACT

The present invention relates to the field of medical devices. More particularly, the present invention relates to therapeutic walkers and devices for preventing tipping of a walker during use. The inventive anti-tipping device can be retrofitted to existing walkers and has at least three or more degrees of freedom relative to the walker along which the anti-tip device can be adjusted to provide for a walker with customizable safety supports.

14 Claims, 7 Drawing Sheets

ANTI-TIPPING DEVICE FOR WALKERS

CROSS-REFERENCE TO RELATED APPLICATIONS

This application relies on the disclosure and claims the benefit of the filing date of U.S. Provisional Patent Application No. 61/059,019 filed Jun. 5, 2008, the disclosure of which is hereby incorporated by reference in its entirety.

BACKGROUND OF THE INVENTION

1. Field of the Invention

The present invention relates to the field of medical devices. More particularly, the present invention relates to therapeutic walkers and devices for preventing tipping of a walker during use. Embodiments of the inventive anti-tipping device can be retrofitted to existing walkers and have at least three or more degrees of freedom relative to the walker along which the anti-tip device can be adjusted to provide for a walker with customizable safety supports.

2. Description of the Related Art

A walker is a medical device primarily for elderly or disabled people who could benefit from assistance or support for maintaining balance or stability while walking or standing. Typically, a standard walker has a frame with four legs raising the walker to about waist or hip height. The top of the frame typically lies in a horizontal plane and during use is gripped by the hands of the user. The walker user supports his or her body weight through their arms which are in turn supported by the walker. Depending on the ability of the person using the walker, the front legs of the walker may or may not be equipped with wheels and the rear legs of the walker can have caster type wheels or glides, such as part of a tennis ball mounted on the bottom of the walker legs for smooth contact with the floor. As a general rule, the more mobile the walker the less mobile the user.

To begin using a walker from a standing position, the person stands with the frame of the walker surrounding the front and sides of their body. The user's hands grip a top portion of the frame of the walker and the user's weight can be supported by the walker through the user's hands and arms. Traditionally, a user will pick up the walker so that all four legs of the walker are off the floor and then the user will place the walker a short distance ahead of the user's starting position. Alternatively, a walker with wheels on the front legs can be moved by the user by lifting only the rear legs of the walker off the floor and then pushing the front wheeled legs of the walker forward a short distance. Similarly, a walker with wheels or gliders also on the rear legs can be pushed forward by way of a sliding motion without lifting the walker off the floor, which is especially beneficial for those with little arm and/or hand grip strength. In any case, the user then steps forward to meet the walker and repeats this process of mobility.

To begin using a walker from a seated position, a user is typically instructed to raise himself or herself up to a standing position without using the walker and then once standing shift their weight to the walker. This generally involves the patient using their arms to push downward against the support in which the user is seated. This technique usually assumes the support in which the patient is seated is stable against potential movement which can be caused by the force exerted by the patient on the support during the attempt to stand, whereas current walkers are typically not as stable to be able to resist such force.

It is instinctive, however, for a patient in a sitting position to instead reach forward toward a walker before attempting to stand. By reaching for the walker while seated and instead of pushing down on the support in which the patient is sitting, the patient has a tendency to pull back on the walker and rely on the walker for support to stand up. Unfortunately, conventional walkers are not equipped to accommodate the patient in this situation and the walker as a result is at risk of tipping back toward the user. With only two legs of the walker on the floor, the walker is less stable and/or may tip over backwards altogether. Under these circumstances, the patient is at a greater risk of falling because the patient has entrusted his or her weight to the walker which cannot now provide adequate support.

Additionally, it has been found that conventional walkers may also have a tendency to tip forward during use. For example, a patient may begin to lose his or her balance when standing or may shift too much of his or her weight forward onto the walker when attempting to stand from a sitting position. Likewise, traditional walkers are also not equipped with means for deterring or preventing tipping of the walker in a sideways direction.

Consequently, a need exists for a device for preventing or deterring a walker from tipping over backward, forward, or sideways and/or for stabilizing the walker during use. Such devices will lead to less injuries resulting from the use of walkers and an increase in confidence of patients otherwise apprehensive about gaining mobility with medical devices, such as walkers.

SUMMARY OF THE INVENTION

In view of the above-described problems, it is an objective of embodiments of the invention to provide an anti-tipping device for walkers. Further, it is desirable to have embodiments of the invention that can be retrofitted to existing walkers. It is even further desirable to have anti-tipping devices which can be configured for releasable engagement with walkers and/or incorporated into or fixed to walkers in such a way that the devices are not removable from the walker.

Walker anti-tip embodiments of the invention, when installed on a walker, can be adjusted relative to the walker to provide for a walker with customizable safety supports.

Embodiments of the present invention include walker anti-tip devices having adjustment means with plural degrees of freedom. For example, walker anti-tip embodiments according to the invention can have at least two or more adjustment means each capable of adjustment by way of at least one degree of freedom. Further, for example, the devices of the invention are capable of being adjusted vertically, horizontally, circumferentially, and/or pivotally, or any combination thereof, e.g., relative to the walker. Even further, for example, the devices of the present invention are adjustable along one, two, three, four, five, six, or seven degrees of freedom. Preferably, the anti-tip device embodiments according to the present invention are capable of adjustment along at least three or more, particularly four, degrees of freedom relative to the walker when equipped thereon.

In certain embodiments of the walkers and anti-tip devices according to the invention, the anti-tip devices comprise means for adjusting the vertical height of the device relative to the walker. Embodiments of the invention can also comprise means for adjusting the support leg(s) of the anti-tip devices pivotally toward or away from the leg of the walker. Further, the anti-tip devices can comprise means for adjusting the support leg(s) of the anti-tip device circumferentially (rotationally) around the leg of the walker. Even further, the anti-tip devices can comprise means for adjusting the support leg(s) of the anti-tip devices at an angle toward the floor on which the walker rests.

Embodiments of the present invention can be installed on any existing walker, optionally without modifying the walker, for example, by way of retrofitting the walker with the adjustable anti-tip device on front and/or rear legs of a walker.

In certain embodiments of the invention, the anti-tip devices comprise one or more, for example two or three, legs that, when installed on a walker, are capable of being adjusted toward the floor on which the walker rests, either at an angle toward the floor and/or vertically and perpendicular toward the floor. Having more than one support leg, for example three, the anti-tipping device can deter tipping of the walker in more than one direction, including forward, backward, and sideways. In certain classes of these embodiments, one or more of the legs of the anti-tip devices are telescopically adjustable. Even further, such adjustability can be achieved by way of an adjustable base on the legs of the anti-tip device.

In embodiments of the invention, the support leg(s) of the anti-tip devices can be equipped with a spring-loaded mechanism at the base of the support leg.

DETAILED DESCRIPTION OF VARIOUS EMBODIMENTS OF THE INVENTION

Figure 1:
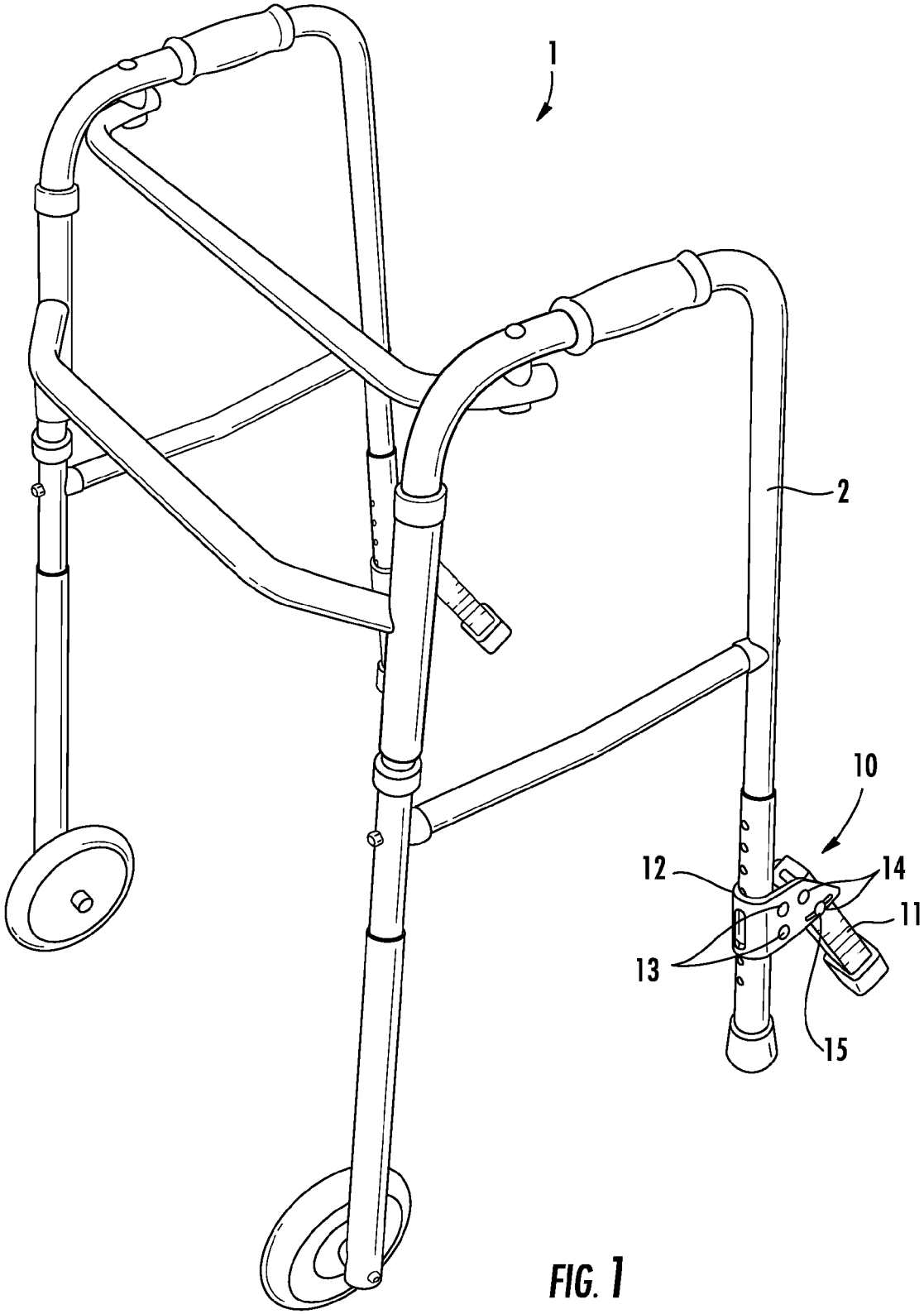
FIG. 1 is a perspective view of a walker comprising a retrofitted anti-tip device on each rear leg, wherein the device is capable of three degrees of freedom of adjustment.

Reference will now be made in detail to various exemplary embodiments of the invention. The following detailed description is presented for the purpose of describing certain embodiments in detail and is, thus, not to be considered as limiting the invention to the embodiments described. Rather, the true scope of the invention is defined by the claims.

Embodiments of the invention include an anti-tip device for a walker comprising: a support leg capable of deterring tipping of a walker during use and an attachment bracket for attaching the support leg to a walker. Preferably, when installed on a walker, the attachment bracket (having means for engaging and means for securing the bracket to the walker) is capable of providing adjustment of the support leg along at least three degrees of freedom. When installed on a walker, the attachment bracket is capable of providing the support leg in a desired fixed position prior to use of the walker or restricting less than all degrees of freedom of adjustment of the support leg to provide for dynamic adjustment during use.

Also included within the scope of the invention are devices having an attachment bracket capable of providing circumferential (rotational), vertical, horizontal, and pivotal (hinge) adjustment of the support leg relative to the leg of the walker.

Embodiments include support legs having a base for the support leg, wherein the base is capable of providing adjustment along at least one degree of freedom. For example, the base can provide adjustment along one degree of freedom, such as by providing the capability of extending the length of the support leg with a base that screws into the bottom of the support leg. Three degrees of freedom in adjustability could be provided by attaching the base to the bottom of the support leg with a ball-and-socket-type connection. Other types of connections providing one or more degrees of freedom of adjustability include a pivot-type, pin-and-hole-type, or spring-loaded-type connection with the support leg.

The connections or joints of embodiments of the present invention can be of any type known in the art, including any listed herein, or combinations thereof. The connections are equally applicable to any joint of any embodiment, for example, at the point where the bracket and walker leg are joined, at the point where the support leg is joined to the bracket, or at the point where the base of the support leg is joined with the support leg.

The devices in certain embodiments of the invention comprise one or more support legs which are capable of being adjusted along at least seven degrees of freedom.

Inventive embodiments further include an anti-tip device for walkers comprising: a support leg capable of deterring tipping of a walker during use; an attachment bracket for attaching the support leg to a walker; wherein, when installed on a walker, the bracket is capable of providing adjustment of the support leg along at least three degrees of freedom; and wherein, when installed on a walker, the bracket is capable of providing the support leg in a desired fixed position prior to use of the walker; and wherein the bracket comprises structure for attaching the bracket to a walker having pin-and-hole-type height adjustable walker legs and the structure is capable of being positioned on a leg of the walker between two of the holes without obstructing the holes. Such structure allows for retrofitting anti-tip devices of the invention to existing walkers.

Embodiments of the invention further include devices capable of being retrofitted to existing walkers wherein the attachment bracket for attaching the leg support to the leg of a walker is capable of providing rotational, vertical, and pivotal adjustment of the support leg relative to the leg of the walker.

In the context of any embodiment of this invention, rotational adjustment can also be characterized as providing circumferential adjustment for example around the leg of a walker. This terminology is equally applicable to structures not having a circular cross-section, such as walker legs and/or support legs with a square cross-section, if desired. Further, adjustment means can also be provide which allow for vertical and horizontal adjustment. Pivotal adjustment can also be characterized as providing adjustment capability simultaneously in vertical and horizontal directions.

The support leg of retrofit anti-tip device embodiments can further comprise a base for the support leg, wherein the base is capable of providing adjustment along at least one degree of freedom. For example, the base can be capable of providing adjustment of the support leg by way of a screw-type, ball-and-socket-type, pivot-type, or spring-loaded-type connection with the support leg, or combinations thereof.

Retrofit anti-tip devices can also be capable adjustment along at least seven degrees of freedom. Any joint or combinations of joints known in the art can be used to achieve the desired number of degrees of freedom for a particular application.

Additionally included is a walker comprising an anti-tip device comprising a support leg capable of deterring tipping of the walker during use; an attachment bracket attaching the support leg to the walker; wherein the bracket is capable of providing adjustment of the support leg along at least three degrees of freedom; and wherein the bracket is capable of providing the support leg in a desired fixed position prior to use of the walker.

Such walkers can comprise an attachment bracket for attaching a support leg, wherein the bracket is capable of providing rotational, vertical, and pivotal adjustment of the support leg relative to the leg of the walker.

Walkers of the present invention can further comprise a base for the support leg, wherein the base is capable of providing adjustment along at least one degree of freedom.

Additionally provided is a walker, wherein the base of the support leg is capable of providing adjustment of the support leg by way of a screw-type, ball-and-socket-type, pivot-type, pin-and-hole-type, or spring-loaded-type connection with the support leg, or any combination thereof, to provide one or more degree of freedom for adjustment.

Walkers of embodiments of the invention can comprise one or more anti-tip devices capable of being adjusted along at least seven degrees of freedom.

Further included is a walker further comprising pin-and-hole-type height adjustable walker legs and wherein the attachment bracket comprises structure capable of being positioned on a walker leg between two of the holes without obstructing the holes.

The anti-tip device can be installed on a walker, for example on a leg of the walker by way of the attachment bracket, in a fixed position or in such a way that provides for releasable engagement of the anti-tip device and walker. Installing the anti-tip device on the walker in a fixed position provides for no adjustment at the joint between the walker and the anti-tip device, however, if other joints of the anti-tip device, for example between the support leg and the attachment bracket and/or between the support leg and the base for the support leg, are not fixed, adjustments can be made at those joints. If all joints of the anti-tip device are fixed, such a configuration would allow for positioning of the support leg in only one position. This desired configuration can also be strategically selected so as to place the support leg in a position capable of deterring or preventing tipping of the walker in one or more directions, for example, backwards, forwards, and/or sideways, as needed by a particular user. Installing the anti-tip device on the walker in such a manner that provides for releasable engagement of the attachment bracket and walker can provide for adjustment of the support leg in one or more positions, for example, up to seven degrees of freedom, typically prior to use of the walker and/or after use and prior to storage.

In the context of the present invention, the term "degree(s) of freedom" refers to the capability of embodiments of the device to be adjusted in a particular direction. Embodiments of the invention can retain one or more degree of freedom for adjustability during use or one or more of the degrees of freedom can be temporary, meaning an adjustment can be made and then fixed prior to using the device. Even further, one or more degrees of freedom can be available for adjustment prior to use of the walker, then fixed for use, then available again for adjustment prior to subsequent uses and/or storage of the walker.

For example, embodiments of the device can have a degree of freedom for adjusting the device relative to the walker in a vertical direction. This can be achieved, for example, by way of a bracket for attaching a support leg to the walker. In this configuration, the distance or height from the floor to the bottom of the anti-tip device can be adjusted by moving the anti-tip device up or down in a vertical direction along the leg of the walker. Once the desired height is obtained, the anti-tip device can be secured to the leg of the walker to deter or prevent further adjustment during use and/or permanently in a fixed position. Preferably, the adjustment means (e.g., a bracket for attaching a support leg to the walker) is capable of releasable engagement and can be adjusted again, e.g., to gain higher or lower clearance over obstacles, such as rocks or other debris that may be encountered when using a walker outdoors.

FIG. 1 is a perspective view of a walker 1 comprising an anti-tip device 10 retrofitted on each rear walker leg 2, wherein the anti-tip device 10 is capable of three degrees of freedom of adjustment. More particularly, walker 1 is a conventional walker having four legs 2. The anti-tip devices 10 comprise at least one anti-tip leg 11, means for engaging 12 the anti-tip device 10 with walker 1 (such as an attachment bracket), means for securing 13 the anti-tip device 10 to walker 1, means for pivotally adjusting 14 the anti-tip leg(s) 11 of the anti-tip device 10 relative to walker leg 2, and pivotal adjustment securing means 15. Although not shown, attaching one or more anti-tip devices 10 to front legs 2 of walker 1 is equally applicable.

As shown in FIG. 1, means for engaging 12 is capable of receiving a walker leg 2 and engaging therewith. The means for engaging 12 can comprise means for releasable engagement (as shown) or permanently fixed to the walker, if desired. As shown, two anti-tip devices 10 are attached to each of two rear walker legs 2 by way of means for engaging 12. In this embodiment, a portion of the means for engaging 12 is shaped complementary to the shape of the corresponding walker leg 2. Such a configuration provides for slideable engagement of the anti-tip device 10 onto walker leg 2. The means for engaging 12 is preferably configured to allow for circumferential (rotational) adjustment and/or vertical adjustment of the anti-tip device 10 relative to walker leg 2.

For example, as shown in FIG. 1, a portion of means for engaging 12 has a generally tubular inner shape which is complementary to the cylindrical outer surface shape of walker leg 2. Accordingly, means for engaging 12 can be rotated around walker leg 2 and securely engaged therewith when a desired support position is obtained, either with means for releasable engagement or in a permanent manner. The attachment bracket 12 can comprise structure for engaging the walker leg which is capable of accommodating the structure that allows for vertical height adjustment of the walker legs regardless of the rotational position of the attachment bracket 12 on the walker leg. For example, a cut out can be relatively small to only accommodate the holes on the walker or can be larger to accommodate the holes when the attachment bracket 12 is rotated on the walker leg to another position. For example, if a particular user has a tendency to tip sideways when using a walker, anti-tip leg 11 can be positioned by way of, e.g., the attachment bracket 12, to the outer side of walker 1 to deter sideways tipping. Likewise, the distance between the floor and the base of anti-tip leg 11 can be adjusted by adjusting the attachment bracket 12 vertically up or down walker leg 2. Such vertical adjustment may be desired for example when using walker 1 on uneven terrain so that various obstacles, such as rocks, can be avoided. Attachment bracket 12 in this embodiment provides for adjustment of anti-tip leg 11 with at least two degrees of freedom, i.e., vertical and/or rotational movement/adjustment, relative to walker leg 2.

Figure 2A:
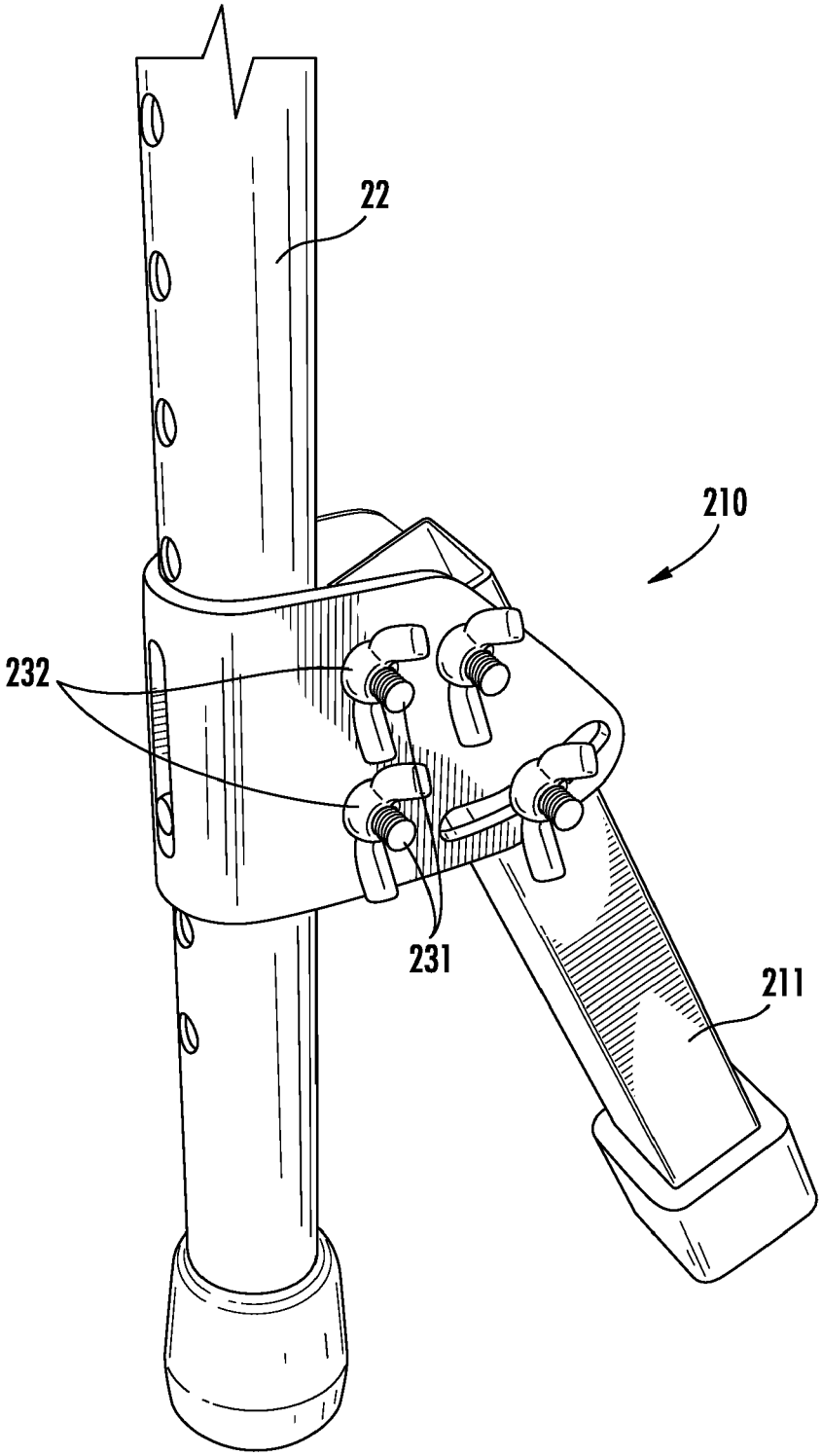
FIGS. 2A-C are perspective views of an anti-tip device.
Figure 2B:
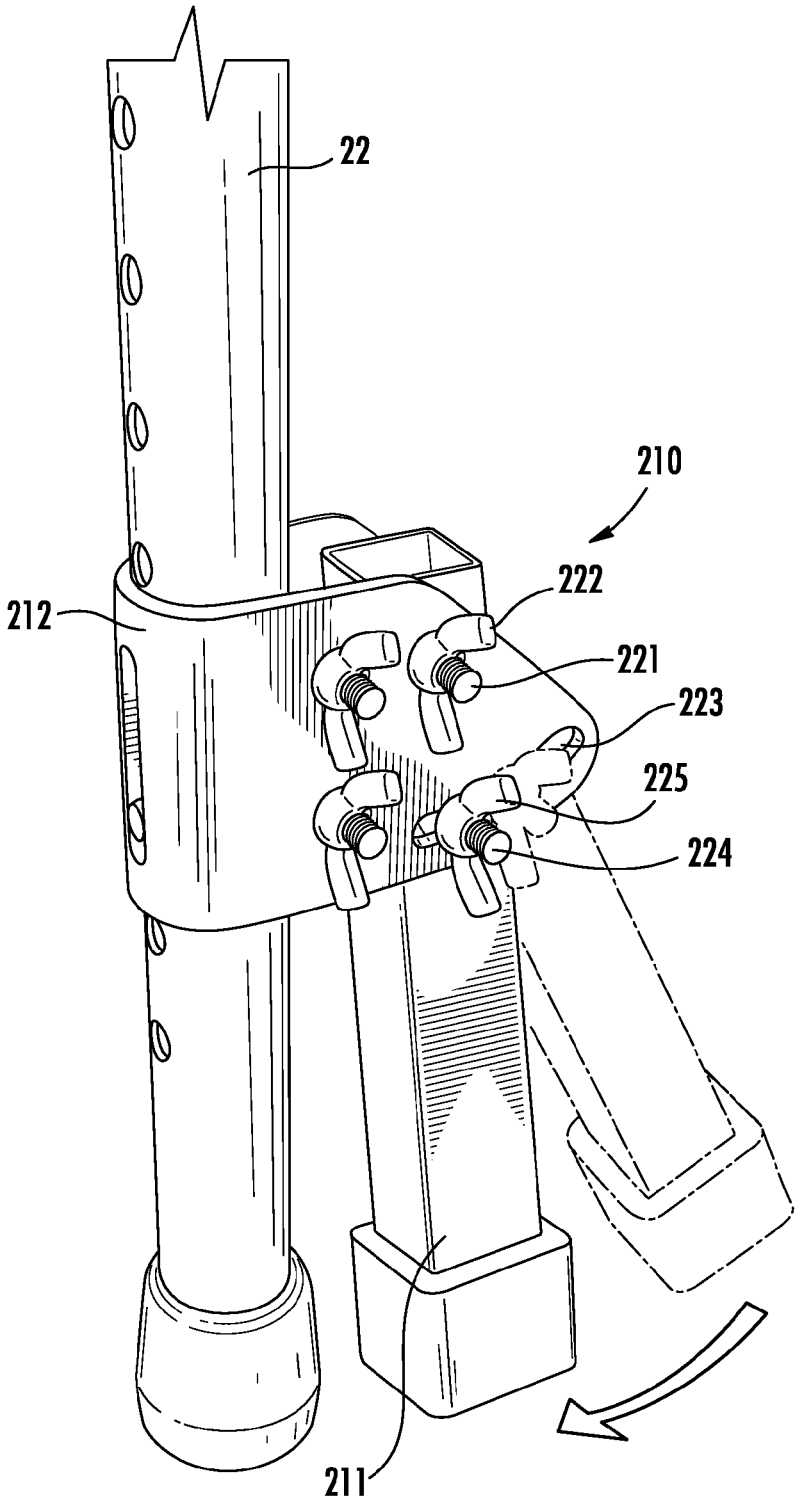
Figure 2C:
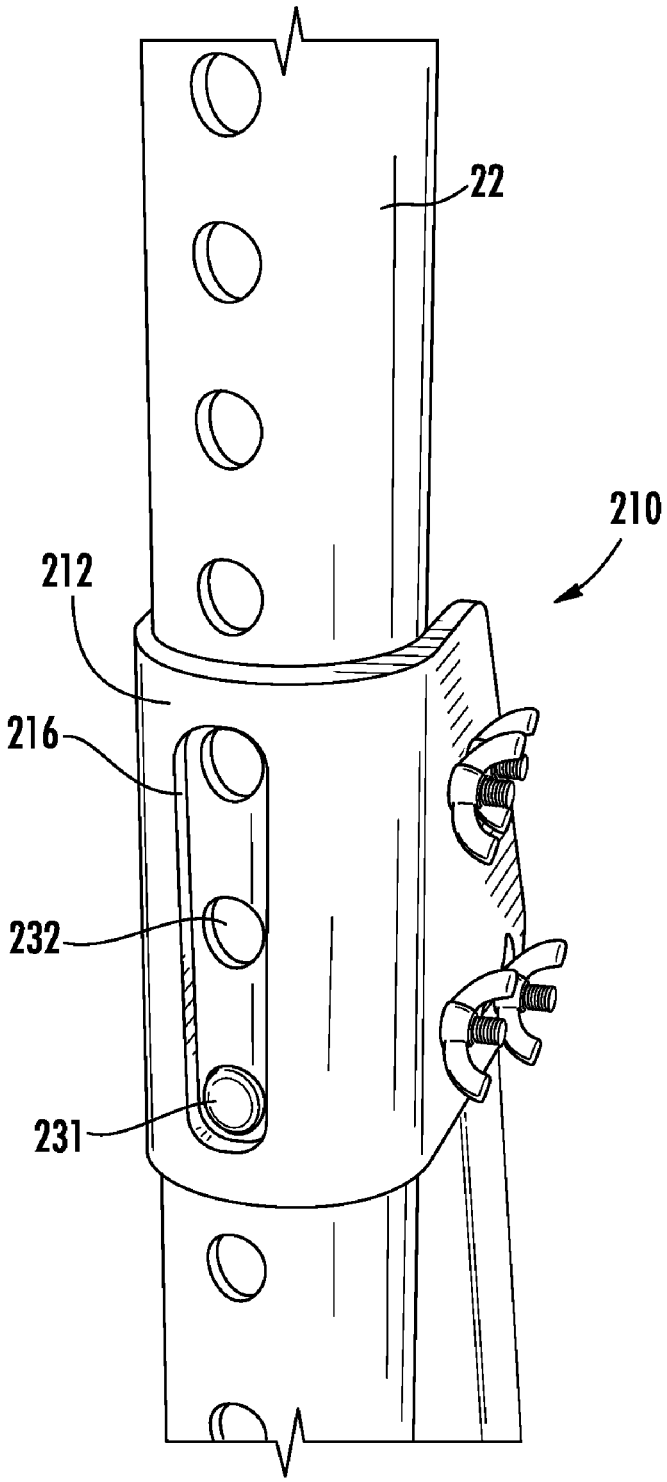

FIGS. 2A-C are perspective views of an anti-tip device 210. In FIG. 2A, anti-tip device 210 comprises anti-tip leg 211 shown in a position behind a rear walker leg 22. Anti-tip device 210 comprises means for securing anti-tip device 210 to the walker. Such means for securing is preferably capable of securing the engagement of the anti-tip device 210 with walker leg 22 in a temporary or permanent engagement. In this embodiment, such means for securing is provided by the combination of a pair of bolts 231 and nuts 232. Any equivalent means for securing can also be used. In this embodiment, means for securing can be adjusted to secure the engagement of the anti-tip device 210 with walker leg 22 or can be adjusted to release the anti-tip device 210 from walker leg 22 by respectively tightening or loosening the nuts 232. For walkers equipped with permanent anti-tip devices 210, means for securing can be provided by any means capable of providing permanent fixation, such as by way of soldering or adhesive.

As is further shown in FIG. 2B, the anti-tip devices 210 can comprise means for pivotally adjusting anti-tip support legs (s) 211. Means for pivotal adjustment can be provided by securing anti-tip leg 211 to the means for engaging 212 by way of the combination of a pivotal bolt 221 and pivotal wing nut 222. With a pivotal bolt and wing nut combination positioned near the top of anti-tip leg 211, a hinge is formed and capability of positioning anti-tip leg 211 toward or away from walker leg 22 in a pivotal manner is provided. Anti-tip leg 211 can be positioned in a desired position relative to walker leg 22 by way of a positioning bolt 224, which passes through anti-tip leg 211 and void 223, and which is capable of sliding within void 223 until a desired position of anti-tip leg 211 is reached. To fix anti-tip leg 211 in a desired position prior to use of the walker, positioning wing nut 225 is provided, which is capable of interacting with positioning bolt 224 to provide for securing anti-tip leg 211 with engagement means 212. In this embodiment, such means for pivotally adjusting the support leg 211 provides for adjustment of anti-tip device 210 in a third degree of freedom (e.g., in a hinge fashion).

As shown in FIG. 2C, means for engaging 212 can be configured so as to provide for retrofitting of anti-tip device 210 onto a walker. For example, anti-tip device 210 can be configured so as to accommodate structure for adjustment of walker legs 22. For example, as shown in this embodiment, existing walker leg 22 comprises pin 231 and hole 232 for adjusting the height of walker legs 22. The anti-tip device 210, in this embodiment, provides for retrofitting the anti-tip device 210 onto walker leg 22 without interfering with the pin 231 and hole 232 type adjustment means of the walker 22, by not covering up any part of the holes 232. In this embodiment, anti-tip device 210 comprises a cut out 216 for this accommodation. This accommodation can also be made in other equivalent ways, for example, by constructing attachment bracket 212 with strips of material having a width that fits between two of the holes 232 without covering them in part or whole. The cut out 216 of this embodiment constitutes an appropriate structure capable of being positioned on a walker leg 22 between two of the holes 232 without obstructing the holes. The width of the cut out can be made larger than as shown to allow for rotation of the attachment bracket 212 around the leg of the walker in other desired positions without the attachment bracket 212 interfering with the walker's vertical height adjustment capability.

Figure 3:
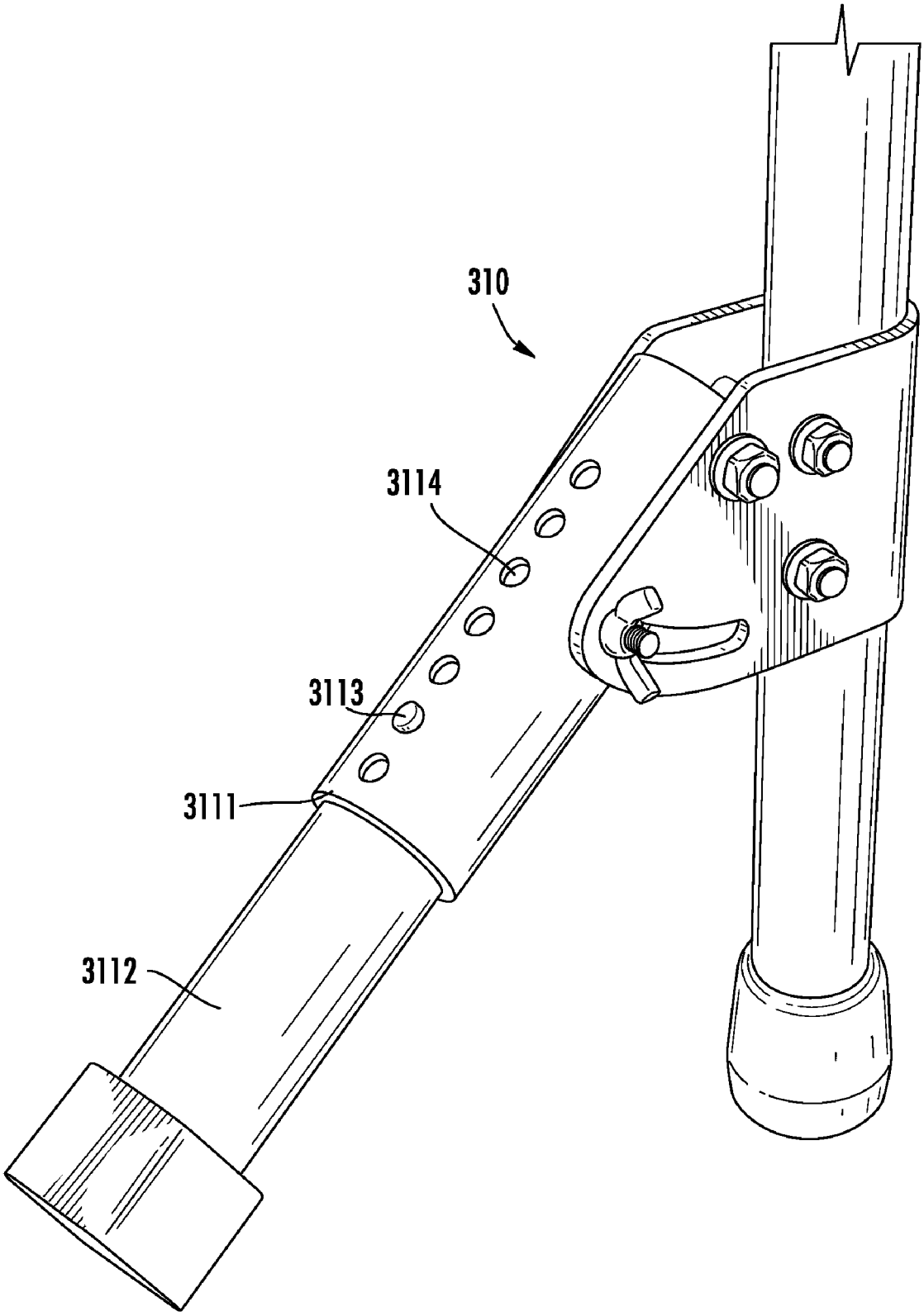
FIG. 3 is a perspective view of an anti-tip device capable of adjustment in four degrees of freedom and having a tubular shaped leg capable of telescopic adjustment

FIG. 3 is a perspective view of an anti-tip device 310 capable of adjustment in four degrees of freedom and having a cylindrical tubular shaped anti-tip leg capable of telescopic adjustment. Embodiments of the present invention can comprise anti-tip devices 310 having any shape anti-tip leg. For example, the anti-tip leg can be tubular with a square, rectangular, or circular cross-section. In the embodiment shown in FIG. 3, anti-tip leg is tubular and has a circular cross-section. Further, anti-tip leg comprises a first outermost tube 3111 having an inner diameter of a desired width, for example about 1 inch, and a second innermost tube 3112 having an outer diameter of a slightly smaller diameter, for example about just under 1 inch. This slight difference in diameters provides for the first outermost tube 3111 to be capable of slideable engagement with the second innermost tube 3112 to provide for telescoping adjustment of the anti-tip leg. The outermost tube 3111 and the innermost tube 3112 can be secured together upon obtaining the desired anti-tip leg length adjustment by way of a retractable pin 3113 in the innermost tube 3112 which is capable of being received by and engaged with a corresponding hole 3114 in the outermost tube. Other quick-release type mechanisms for adjusting and securing can be used, such as parts providing for an interference fit and/or threaded engagement. Accordingly, the length of the anti-tip leg can be adjusted shorter or longer, which is especially desirable for providing different degrees of tilt capability of the walker and/or clearance over obstacles. The anti-tip leg can also be adjusted in length by way of a base (not shown) which is capable of telescopic adjustment relative to the anti-tip leg. Even further, it is possible to adjust the anti-tip leg in a position where it is in contact with the floor during use of the walker, for example, if part of a tennis ball, slider, or other means for providing slideable contact with the floor is used in combination with the anti-tip leg.

Figure 4:
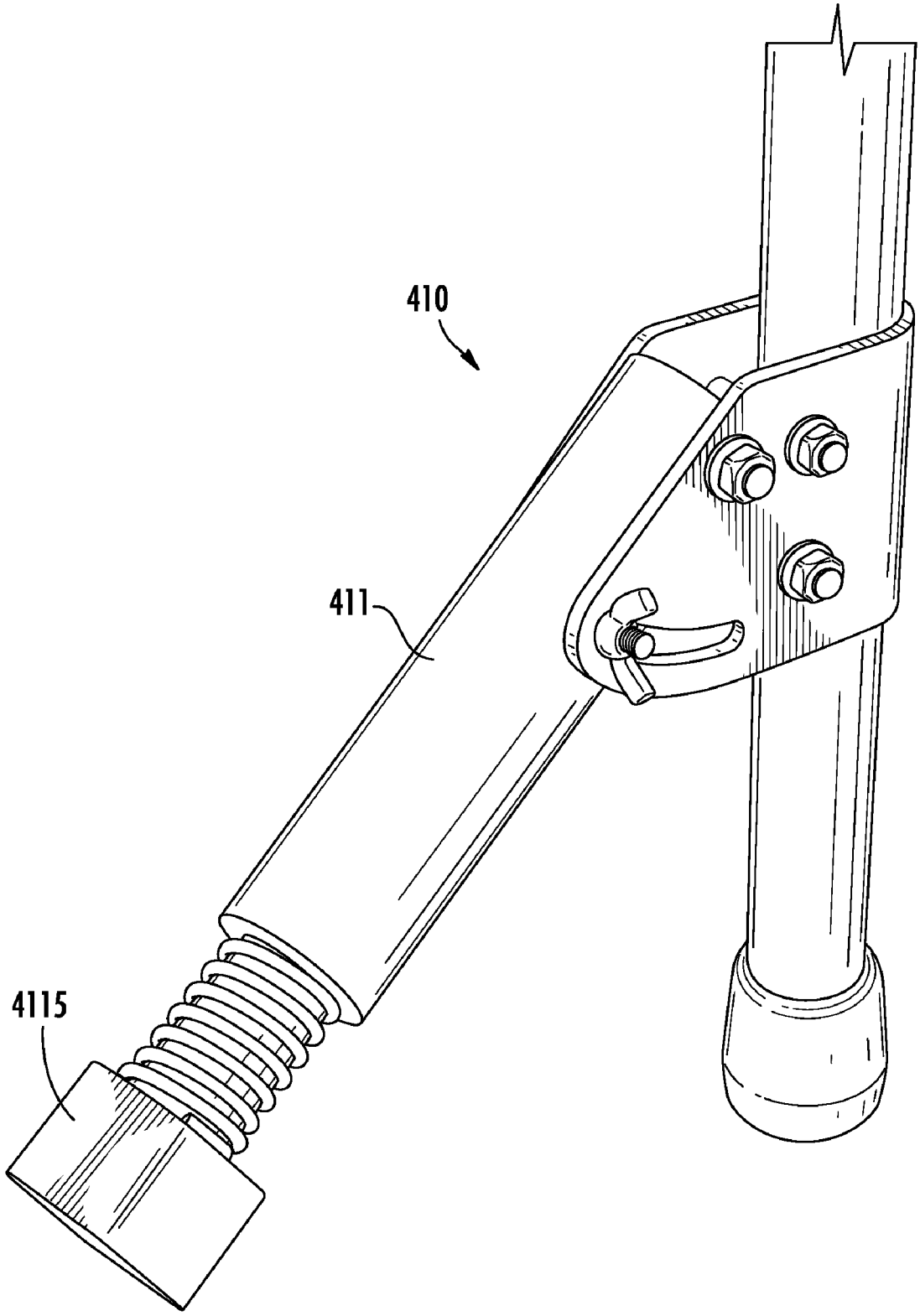
FIG. 4 is a perspective view of an anti-tip device comprising a spring-loaded base on the leg of the anti-tip device.

FIG. 4 is a perspective view of an anti-tip device 410 comprising a spring-loaded base 4115 on the bottom of the leg of the anti-tip device. Spring-loaded base 4115 is especially suitable for situations where it is desired to have some flexibility in the stability of the walker during use. For example, it may be desirable to have anti-tip legs 411 which are slightly adjustable during use of the walker so that use of the walker is less jarring on the user. A spring-loaded base 4115 on the tip of anti-tip leg 411 can provide such flexibility.

Figure 5:
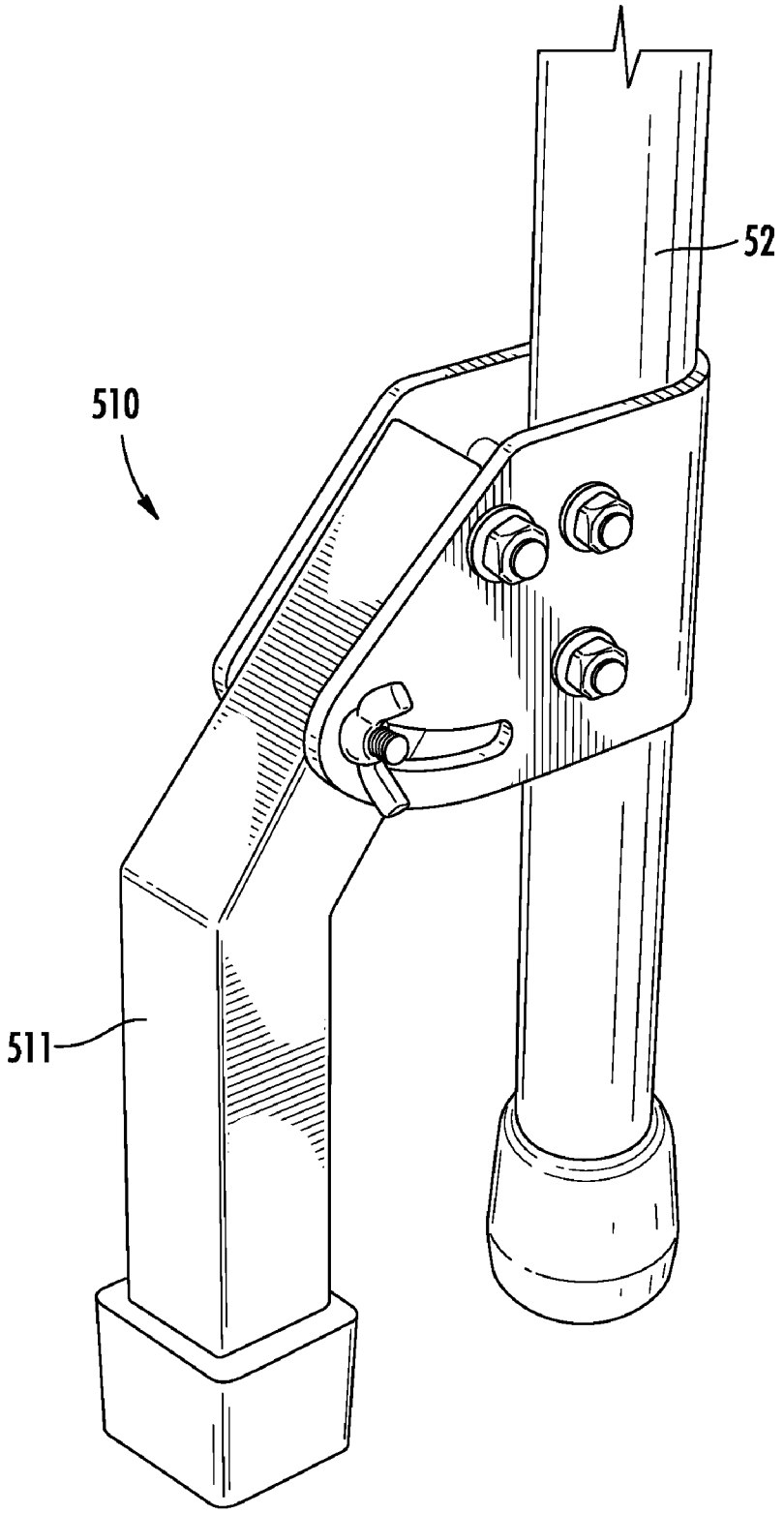
FIG. 5 is a perspective view of an anti-tip device having an angled leg.

FIG. 5 is a perspective view of an anti-tip device 510 having an angled anti-tip leg 511. Angled anti-tip legs 511 may be desirable in situations where it is beneficial to have the anti-tip leg 511 in a position that will cause minimal interference with a user's feet during use of the walker but sufficient support as well. As shown in the embodiment of FIG. 5, the anti-tip leg 511 can extend outwardly from the walker at an angle, for example 45 degrees, toward the floor and have a bend in anti-tip leg 511, for example at 45 degrees so that the bottom portion of the anti-tip leg 511 is about parallel with walker leg 52. Such a configuration will allow for the base of the anti-tip device to be in substantial contact with the floor and for the anti-tip leg 511 to be positioned out of the way of the user's feet.

Other embodiments of anti-tip devices of the present invention include devices having multiple anti-tip legs on each anti-tip device, for example two or three. One or more of the legs of the anti-tip devices can be adjustable and fixed in a desired position during use of the walker or provide for dynamic adjustment during use, such as by way of spring-loaded bases.

The anti-tip devices according to embodiments of the invention can be made of any material known in the art. For example, construction materials can include aluminum, steel, plastic, or any combination thereof, or any conventional material used for walkers.

Embodiments of the invention include anti-tip devices having one or more anti-tip leg that is not adjustable in any direction. In such embodiments it may be desirable to provide a walker with fixed anti-tipping devices.

The present invention has been described with reference to particular embodiments having various features. It will be apparent to those skilled in the art that various modifications and variations can be made in the practice of the present invention without departing from the scope or spirit of the invention. One skilled in the art will recognize that these features may be used singularly or in any combination based on the requirements and specifications of a given application or design. Other embodiments of the invention will be apparent to those skilled in the art from consideration of the specification and practice of the invention. The description of the invention provided is merely exemplary in nature and, thus, variations that do not depart from the essence of the invention are intended to be within the scope of the invention.

The invention claimed is:

1. A walker anti-tip device comprising:

a support leg capable of deterring tipping of a walker during use; and an attachment bracket for attaching the support leg to a leg of the walker;

wherein, when installed on the walker, the bracket has one or more joints individually or cooperatively capable of providing for rotational, vertical, and pivotal adjustment of the support leg relative to the walker into a fixed position prior to traversal of the walker across a surface for walking; and wherein the fixed position is capable of remaining fixed during traversal of the walker across a surface for walking; and wherein the fixed position provides the support leg in a position capable of deterring tipping of the walker during traversal of the walker across a surface for walking.

2. The device according to claim 1 further comprising a base for the support leg, wherein the base is capable of providing additional adjustment of the support leg.

3. The device according to claim 2, wherein the base is capable of providing adjustment of the support leg by way of a screw-type, ball-and-socket-type, pivot-type, pin-and-hole-type, or spring-loaded-type connection with the support leg, or combinations thereof.

4. An anti-tip device for a walker comprising:

a support leg capable of deterring tipping of a walker during use;

an attachment bracket for attaching the support leg to the walker;

wherein, when installed on the walker, the bracket has one or more joints individually or cooperatively capable of providing for rotational, vertical, and pivotal adjustment of the support leg relative to the walker into a fixed position prior to traversal of the walker across a surface for walking; and wherein the fixed position is capable of remaining fixed during traversal of the walker across a surface for walking; and wherein the fixed position provides the support leg in a position capable of deterring tipping of the walker during traversal of the walker across a surface for walking; and wherein the bracket comprises structure for attaching the bracket to the walker having pin-and-hole-type height adjustable walker legs and the structure is capable of being positioned on the walker legs between two of the holes without obstructing the holes.

5. The device according to claim 4 further comprising a base for the support leg, wherein the base is capable of providing additional adjustment of the support leg.

6. The device according to claim 5, wherein the base is capable of providing adjustment of the support leg by way of a screw-type, ball-and-socket-type, pivot-type, or spring-loaded-type connection with the support leg, or combinations thereof.

7. A walker comprising an anti-tip device comprising:

a support leg capable of deterring tipping of the walker during use;

an attachment bracket attaching the support leg to the walker;

wherein, when installed on the walker, the bracket has one or more joints individually or cooperatively capable of providing for rotational, vertical, and pivotal adjustment of the support leg relative to the walker into a fixed position prior to traversal of the walker across a surface for walking; and wherein the fixed position is capable of remaining fixed during traversal of the walker across a surface for walking; and wherein the fixed position provides the support leg in a position capable of deterring tipping of the walker during traversal of the walker across a surface for walking.

8. The walker according to claim 7 further comprising a base for the support leg, wherein the base is capable of providing additional adjustment of the support leg.

9. The walker according to claim 8, wherein the base is capable of providing adjustment of the support leg by way of a screw-type, ball-and-socket-type, pivot-type, pin-and-hole-type, or spring-loaded-type connection with the support leg, or combinations thereof.

10. The walker according to claim 7 further comprising pin-and-hole-type height adjustable walker legs and wherein the attachment bracket comprises structure capable of being positioned on any one of the walker legs between two of the holes without obstructing the holes.

11. The walker according to claim 10, wherein the bracket is attached to a leg of the walker in a fixed position.

12. The walker according to claim 10, wherein the bracket is capable of releasable engagement with a leg of the walker.

13. The walker according to claim 7, wherein the bracket is attached to a leg of the walker in a fixed position.

14. The walker according to claim 7, wherein the bracket is capable of releasable engagement with a leg of the walker.

* * * * *